US010907831B2

(12) United States Patent
Petty, Sr. et al.

(10) Patent No.: US 10,907,831 B2
(45) Date of Patent: Feb. 2, 2021

(54) RAM PRESSURE RECOVERY FUEL NOZZLE WITH A SCOOP

(71) Applicants: Rolls-Royce Corporation, Indianapolis, IN (US); Rolls-Royce North American Technologies Inc., Indianapolis, IN (US)

(72) Inventors: Jack D. Petty, Sr., Indianapolis, IN (US); John Holdcraft, Carmel, IN (US); Kevin Sauer, Plainfield, IN (US)

(73) Assignees: Rolls-Royce Corporation, Indianapolis, IN (US); Rolls-Royce North American Technologies Inc., Indianapolis, IN (US)

( * ) Notice: Subject to any disclaimer, the term of this patent is extended or adjusted under 35 U.S.C. 154(b) by 278 days.

(21) Appl. No.: 15/972,320

(22) Filed: May 7, 2018

(65) Prior Publication Data

US 2019/0338952 A1 Nov. 7, 2019

(51) Int. Cl.

| | |
|---|---|
| ***F23R 3/14*** | (2006.01) |
| ***F23R 3/28*** | (2006.01) |
| ***F23D 11/10*** | (2006.01) |
| ***F23R 3/26*** | (2006.01) |

(52) U.S. Cl.

CPC ..... *F23R 3/14* (2013.01); *F23D 11/107* (2013.01); *F23R 3/26* (2013.01); *F23R 3/283* (2013.01); *F23R 3/286* (2013.01)

(58) Field of Classification Search

CPC ..... F23R 3/04; F23R 3/10; F23R 3/28; F23R 3/286; F02C 3/103; F02C 3/05; F02C 3/08; F02C 7/22; F02C 7/222; F23C 7/008

See application file for complete search history.

(56) References Cited

U.S. PATENT DOCUMENTS

| | | | | | |
|---|---|---|---|---|---|
| 2,780,061 | A * | 2/1957 | Clarke | F23R 3/283 | 60/740 |
| 3,631,675 | A * | 1/1972 | Keiter | F23R 3/26 | 60/737 |
| 4,419,863 | A * | 12/1983 | Dvorak | F23R 3/14 | 60/748 |
| 4,549,402 | A * | 10/1985 | Saintsbury | F23R 3/28 | 60/738 |
| 5,701,732 | A | 12/1997 | Nesbitt et al. | | |
| 7,500,364 | B2 * | 3/2009 | Schumacher | F23R 3/04 | 60/751 |

(Continued)

*Primary Examiner* — Jason H Duger

*Assistant Examiner* — Todd N Jordan

(74) *Attorney, Agent, or Firm* — Brinks Gilson & Lione

(57) ABSTRACT

A fuel injection system may include a fuel spray nozzle including a nozzle head and a nozzle stem. The nozzle head may include an air channel and a swirler in fluid communication with the air channel. The nozzle stem may extend into a compressor discharge pressure cavity and convey fuel to the air channel. The air channel may combine air from the swirler with the fuel from the nozzle stem and convey a mixture of fuel and air to a combustor. The fuel injection system may further include a scoop. The scoop may be coupled to the fuel spray nozzle. The scoop may receive air that flows into the compressor discharge pressure cavity from a diffusor. An outer surface of the fuel spray nozzle and an inner surface of the scoop define a duct in fluid communication with the swirler. The swirler may receive air from the duct.

19 Claims, 3 Drawing Sheets

(56) References Cited

U.S. PATENT DOCUMENTS

| | | | | |
|---|---|---|---|---|
| 7,966,821 | B2 * | 6/2011 | Zupanc | F23R 3/343 60/748 |
| 8,096,135 | B2 | 1/2012 | Caples | |
| 8,661,829 | B2 * | 3/2014 | Bourgois | F04D 29/441 60/752 |
| 9,127,841 | B2 * | 9/2015 | Bourgois | F23R 3/10 |
| 9,404,422 | B2 * | 8/2016 | Zupanc | F23R 3/12 |
| 10,443,850 | B2 * | 10/2019 | Bourgois | F23R 3/50 |

* cited by examiner

RAM PRESSURE RECOVERY FUEL NOZZLE WITH A SCOOP

TECHNICAL FIELD

This disclosure relates to fuel injection and, in particular, to fuel injection for gas turbine engines.

BACKGROUND

In a gas turbine engine, fuel and air are provided to a combustor. A compressor may pressurize the air received by the combustor. The pressurized air may mix with fuel from a fuel injector. The manner in which fuel and air are conveyed to combustor may impact performance, fuel consumption, and other design considerations of the gas turbine engine. Present approaches to providing air and fuel to the combustor may suffer from a variability of drawbacks, limitations and disadvantages.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

By way of an introductory example, a fuel injection system is provided. The fuel injection system may include a fuel spray nozzle having a nozzle head and a nozzle stem. The nozzle head may include an air channel and a swirler in fluid communication with the air channel. The nozzle stem may extend into a compressor discharge pressure (CDP) cavity and convey fuel to the air channel. The air channel may combine air from the swirler with the fuel from the nozzle stem and convey a mixture of fuel and air to a combustor. The fuel injection system may further include a scoop. The scoop may be coupled to the fuel spray nozzle. The scoop may receive air flowing in the compressor discharge pressure cavity from a diffusor. An outer surface of the fuel spray nozzle and an inner surface of the scoop define a duct in fluid communication with the swirler. The swirler may receive air from the duct.

One interesting feature of the systems and methods described below may be that the scoop may improve ram pressure for air received by the fuel spray nozzle. Air from the diffusor may flow along the duct to a portion of the fuel spray nozzle that receives the air. The scoop may minimize velocity loses of air flow received by the fuel spray nozzle by guiding air from the diffusor to the fuel spray nozzle. In a gas turbine engine that includes a centrifugal compressor, the diffusor may be located radially outward from an air inlet of the fuel spray nozzle. The scoop may recover ram pressure benefit by directing radially flowing air to the air inlet of the fuel spray nozzle.

Alternatively or in addition, an interesting feature of the systems and methods described below may be that coupling the scoop to the fuel spray nozzle may improve design flexibility. Depending on the implementation, various types of scoops may be selected in order to achieve desired shapes and cross sections for the duct. A specific type of scoop may be selected and coupled to the fuel spray nozzle with minimal impact to surrounding components in the compressor discharge cavity. Alternatively or in addition, coupling the scoop to the fuel spray nozzle instead of the combustor may minimize the footprint of the scoop in the compressor discharge cavity. Additional or alternative benefits, efficiencies, and improvements are made evident in the system and methods described below.

Figure 1:
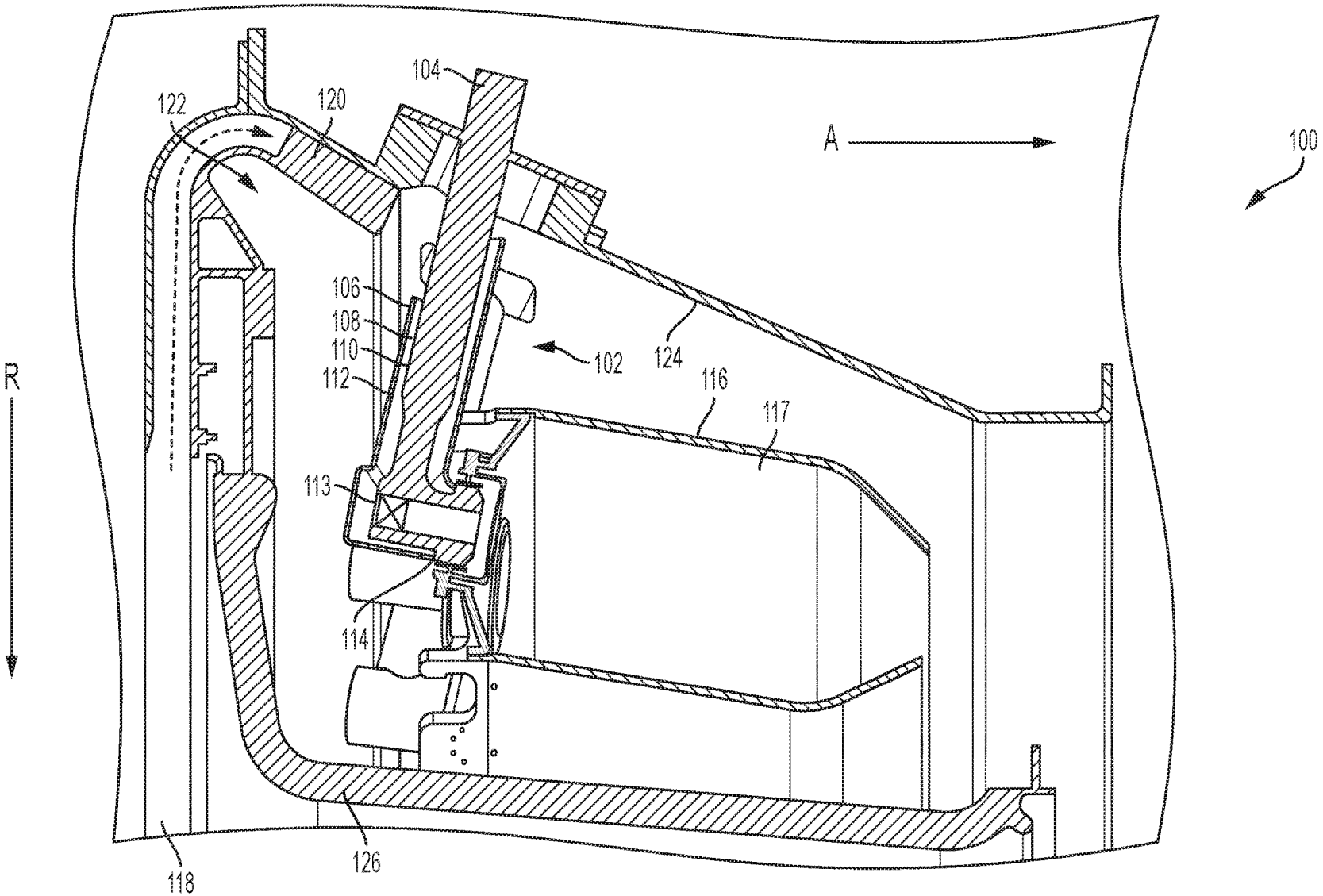
FIG. 1 illustrates an example of a fuel injection system for a gas turbine engine.

FIG. 1 illustrates an example of a fuel injection system 100 for a gas turbine engine (only a portion of the gas turbine engine is shown in FIG. 1). The fuel injection system 100 may include a nozzle assembly 102. The nozzle assembly 102 may include a fuel spray nozzle 104 and a scoop 106.

The fuel spray nozzle 104 may facilitate dispersion of fuel using pressurized air. The fuel spray nozzle 104 may receive fuel, such as liquid fuel, from a fuel source. The fuel spray nozzle 104 may combine the fuel with air to atomize the fuel. The mixing of fuel and air may occur inside and/or outside of the fuel spray nozzle 104. For example, the fuel spray nozzle 104 may output a combined mixture of fuel and air. Alternatively or in addition, the fuel spray nozzle 104 may separately output fuel and air which is combined immediately outside of the fuel spray nozzle 104.

The scoop 106 may include a structure that defines a duct 108 to receive air for the fuel spray nozzle 104. The scoop 106 may be adjacent to the fuel spray nozzle 104 and define the duct 108 with the fuel spray nozzle 104. In some examples, the fuel spray nozzle 104, or a portion thereof, may be disposed in the scoop 106. For example, the scoop 106 may partially or completely wrap around the fuel spray nozzle 104. Alternatively or in addition, the scoop may have cylindrical portion and the fuel spray nozzle 104, or a portion thereof, may be positioned within the cylindrical portion. In other examples, the scoop may include a sheet that extends along at least a portion of the fuel spray nozzle 104. The scoop 106 and the fuel spray nozzle 104 may, together, form a unitary structure. Alternatively or in addition, the scoop 106 may be coupled to the fuel spray nozzle. For example, the scoop 106 may be welded or brazed to the fuel spray nozzle 104 during manufacture.

The duct 108 may include the space in between the fuel spray nozzle 104 and the scoop 106. At least a portion of the scoop 106 may be offset from the fuel spray nozzle 104 such that a gap between the scoop 106 and the fuel spray nozzle 104 may form the duct 108. For example, the fuel spray nozzle 104 may include an outer surface 110 and the scoop 106 may include an inner surface 112. The outer surface 110 of the fuel spray nozzle 104 and the inner surface 112 of the scoop 106 may define the duct 108.

Air received by the duct 108 may travel along the duct 108 along a radial direction or semi-radial, such as an inward radial direction R relative to the gas turbine engine. For example, air traveling in the duct 108 may travel along the duct between the inner surface of the scoop and the outer surface of the fuel spray nozzle. The scoop may redirect the airflow and cause the air in the duct to flow along an axial direction A. The scoop 106 may redirect an airflow from the radial direction R to an axial direction A. The fuel spray nozzle may receive the air after it has been redirected to flow along the axial direction A.

The fuel spray nozzle 104 may include an air inlet or multiple air inlets. In general, an air inlet of the fuel spray nozzle 104 may refer to an opening at least partially defined by the fuel spray nozzle 104 that receives air from the duct 108. In some examples, the scoop 106 may further define the air inlet. As illustrated in FIG. 1, the fuel spray nozzle 104 may include a first air inlet 113 and a second air inlet 114. The first air inlet 113 may be radially offset and/or axially offset from the second air inlet 114. Air received by the first air inlet 113 may mix with fuel inside of the fuel spray nozzle 104. Air received by the second air inlet 114 may be mixed with fuel to form a mixture of fuel and air output from the fuel spray nozzle 104.

The system may further include a combustor 116. The combustor 116 may receive fuel and air provided by the nozzle assembly 102. For example, the nozzle assembly 102 may disperse fuel, air, and/or a mixture of fuel and air into the combustor 116. The combustor may include a combustion chamber 117. The combustion chamber may receive fuel and/or a mixture of fuel and air form the fuel spray nozzle 104. Alternatively or in addition, the combustion chamber 117 may receive air from the duct 108.

The system may further include a compressor 118 and a diffusor 120. The compressor 118 may include rotating blades or an impeller (not shown) that compresses air received by the gas turbine engine. In some examples, the compressor 118 may include a centrifugal compressor. The centrifugal compressor may direct air in a radial direction, relative to the gas turbine engine. The diffusor 120 may include a section of the gas turbine engine or a structure included in the gas turbine engine that prepares air from the compressor 118 for the combustor 116. The diffusor 120 may discharge air into a CDP cavity 122. For example, the diffusor 120 may discharge radially inward, relative to the gas turbine engine.

The CDP cavity 122 may include a region of the gas turbine engine that receives air from the compressor 118 and/or the diffusor 120. The CDP cavity 122 may be defined by one or more wall. For example, a first wall 124, such as an engine case and/or or a structure inside of the engine case, may define the CDP cavity 122. Alternatively or in addition, the CDP cavity 122 may be defined by a second wall 126 that separates the CDP cavity 122 from the compressor 118. In some examples, the nozzle assembly 102, or a portion thereof, may be positioned in the CDP cavity 122. The fuel spray nozzle 104 may extend into the CDP cavity 122 from the first wall 124 of the CDP cavity 122. For example, the fuel spray nozzle 104 may extend through the first wall 124 of the CDP cavity 122. The scoop 106, or a portion thereof, may be disposed in the CDP cavity 122.

The fuel injection system 100 may be implemented in many ways. In some examples, the fuel injection system 100 may include the scoop 106 without the fuel spray nozzle. Alternatively, the system may include the fuel spray nozzle 104 and the scoop 106. In other examples, the scoop 106 may be manufactured in one or more pieces and then subsequently joined with other components, such as the fuel spray nozzle 104. In other examples, the scoop 106 and the fuel spray nozzle 104 may form a unitary structure. In further examples, the fuel injection system 100 may include the compressor 118, the combustor 116, the diffusor 120, and/or the gas turbine engine.

In some examples, the nozzle assembly 102 and the combustor 116 are separate structures that are joined during manufacturing. For example, the scoop 106 may be attached to the fuel spray nozzle 104 and not attached to the combustor 116. The duct 108 may be defined between the fuel spray nozzle 104 and the scoop 106, but not the combustor 116. Coupling the scoop 106 to the fuel spray nozzle 104 without coupling the scoop 106 to the combustor 116 minimizes the footprint of the scoop. However, in other examples, the scoop 106 may attach to the combustor 116 to achieve other design objectives.

The duct 108 defined by the scoop 106 may receive air released from the diffusor 120. The scoop 106 may improve ram pressure benefit for air received by the fuel spray nozzle 104. For example, the scoop 106 may receive air flowing from the diffusor 120 and guide the air to a portion of the fuel spray nozzle 104 that receives the air.

In examples where the compressor 118 includes a centrifugal compressor, the diffusor 120 may be located radially outward from the portion of the fuel spray nozzle 104 that receives air. The scoop 106 may receive air flowing in the radial direction R, or a semi-radial direction, and guide the air to a specific portion of the fuel spray nozzle 104.

Figure 2:
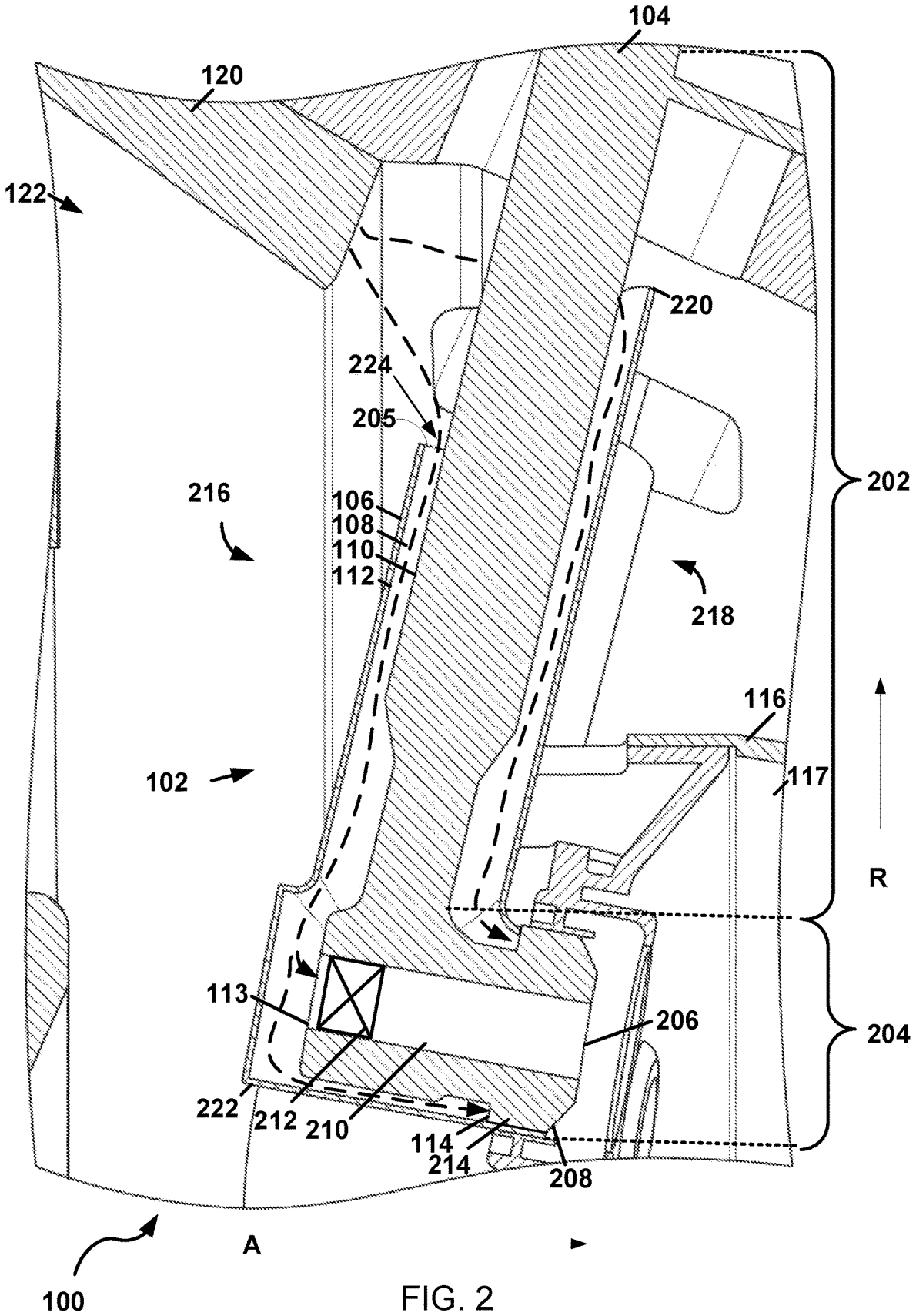
FIG. 2 illustrates an example of a nozzle assembly for the fuel injection system.

FIG. 2 illustrates an example of the nozzle assembly 102 for the fuel injection system 100. The fuel spray nozzle 104 may include a nozzle stem 202 and a nozzle head 204. The nozzle stem 202 may include an elongated portion of the fuel spray nozzle 104. The nozzle stem 202 may extend into the CDP cavity 122. In some examples, the nozzle stem 202 may extend into the CDP cavity 122 from a wall of the CDP cavity 122 in the inward radial direction R. Alternatively or in addition, the nozzle stem 202 may extend through the wall of the CDP cavity 122. The nozzle stem 202 may receive and/or convey fuel. For example, the nozzle stem 202 may include internal passages (not shown in FIG. 2) which facilitate the flow of liquid fuel to the nozzle head 204. The nozzle stem 202 may receive fuel provided by a fuel source.

The nozzle head 204 may include a portion of the fuel spray nozzle 104 that receives fuel and/or air. For example, the nozzle head 204 may receive fuel from the nozzle stem 202 and air from the duct 108. The nozzle head 204 may facilitate mixing or atomization of the fuel using air received by the duct 108. For example, the nozzle head 204 may include one or more air inlets of the fuel spray nozzle 104, such as the first air inlet 113 and the second air inlet 114, previously described in reference to FIG. 1.

The nozzle head 204 may include an outlet or multiple outlets. In general, an outlet of the nozzle head 204 may provide air, or a mixture of fuel and air, to a combustor 116. For example, the nozzle head 204 may receive air from the duct 108 and convey the air through the outlet of the nozzle head 204. In some examples, air may mix with fuel inside of the nozzle head 204. The outlet of the nozzle head 204 may provide a mixture of fuel and air. In another example, the outlet may provide air without fuel. The nozzle head 204 may include any number of outlets. For example, as illustrated in FIG. 2, the nozzle head 204 may include a first outlet 206 and a second outlet 208. The first outlet 206 may output a mixture of fuel and air and the second outlet 208 may output air without fuel. In other examples, the second outlet 208 may also output a mixture of fuel and air. The first outlet 206 and the second outlet 208 may be arranged such that their respective outputs induce further mixing of fuel and air in a combustion chamber of the combustor 116. For example, the first outlet 206 may be radially offset from the second outlet 208. In some examples, the first outlet 206 may be radially inward of the second outlet 208. For example, the second outlet 208 may be concentric with the first outlet 206. Alternatively or in addition, the first outlet 206 may be axially offset from the second outlet 208.

The scoop 106 may receive air flowing in the CDP cavity 122 from the diffusor 120. The inner surface 112 of the scoop 106 and the outer surface 110 of the fuel spray nozzle 104 may define the duct 108. The duct 108 may extend along the outer surface 110 of the fuel spray nozzle 104 from the nozzle stem 202 to the nozzle head 204. For example, the outer surface 110 of the fuel spray nozzle 104 may include an outer surface of the nozzle stem 202 and/or an outer surface of the nozzle head 204. As illustrated in FIG. 2, the scoop 106 may be coupled to the fuel spray nozzle 104 at the nozzle head 204. In other examples, the scoop 106 may be coupled to the fuel spray nozzle 104 at the nozzle stem 202 and/or the nozzle head 204. At least a portion of the nozzle head 204 and at least a portion of the nozzle stem 202 may be disposed in the scoop 106.

The nozzle head 204 may include an air channel 210 or multiple air channels. The air channel 210 may refer to a passageway that receives air from the duct 108 and facilitates the passage of air into the combustor 116. The air channel 210 may be partially or completely defined by the nozzle head 204 or components inside of the nozzle head 204. Alternately or in addition, the air channel 210 may be defined by the scoop 106. For example, the scoop 106 and the nozzle head 204 may define the air channel.

The air channel 210 may convey air and/or a mixture of fuel and air. For example, the duct 108 may be in fluid communication with the air channel 210. The air channel 210 may receive the air from the CDP cavity 122 via the duct 108. Alternatively or in addition, the air channel 210 may receive fuel from the nozzle stem 202. The received air from the duct 108 may flow through the air channel 210 and mix with fuel inside the air channel 210. The air channel 210 may guide the air, fuel, and/or a mixture of fuel and air through the nozzle head 204. For example, the air channel 210 may guide the air received from the duct 108 in an axial direction or semi-axial direction toward the combustor 116. In other examples, the air channel 210 may receive air without receiving fuel.

The nozzle head 204 may further include a swirler or multiple swirlers. A swirler may refer to a structure that induces swirl to air flowing into, air flowing inside of, and/or air flowing out of one or more air channels. The swirler may include, for example, a passage including one or more vanes that add turbulence and/or a circumferential motion to air passing through the passage. The swirler may accept air, fuel, and/or a combination of air and fuel.

The nozzle head 204 may include one or more swirlers. For example, the nozzle head 204 may include an inner swirler 212 and an outer swirler 214. The inner swirler 212 may receive air conveyed by the duct 108 and/or the air channel 210. The inner swirler 212 may be included in or defined by part of the air channel 210. Alternatively, the inner swirler 212 may define all or part of the air channel 210. In other examples, the inner swirler 212 may be positioned immediately outside of the input or the output of the air channel 210. Air affected by the inner swirler 212 may flow into, though, and/or out of the air channel 210. For example, the air channel 210 may receive air from the inner swirler 212.

In some examples, the inner swirler 212, or any other example of a swirler, may be positioned in the air channel 210. Fuel received from the nozzle stem 202 may flow into the inner swirler 212. In other examples, the fuel may flow into the air channel 210 downstream and/or upstream of the inner swirler 212.

The outer swirler 214 may receive air conveyed by the duct 108. For example, air flowing in the duct 108 may flow to the outer swirler 214 via the second air inlet 114. The outer swirler 214 may convey air and/or a mixture of fuel and air out of the nozzle head 204 via the second outlet 208 of the nozzle head 204. Alternatively or in addition, the outer swirler 214 may define the second air inlet 114 and/or the second outlet 208 of the nozzle head 204. The outer swirler 214 may be located outside of the air channel 210. For example, air received by the outer swirler 214 may bypass the air channel 210. Alternatively or in addition, the outer swirler 214 may be located in or define a second air channel.

The outer swirler 214 and/or the inner swirler 212 may be positioned to induce mixing of fuel and air. In some examples, the outer swirler 214 may be positioned radially outward form the inner swirler 212. For example, the outer swirler 214 may be concentric with the inner swirler 212. Alternatively or in addition, the outer swirler 214 may be axially offset from the inner swirler 212, such that the outer swirler 214 is closer to the combustor 116 than the inner swirler 212.

The scoop 106 and the fuel nozzle 104 may define an opening 205 of the duct 108. For example, the outer surface 110 of the fuel spray nozzle 104 and an end of the scoop 106 may define the opening 205. The opening 205 may be positioned along the nozzle stem 202. In some examples, the opening 205 may wrap around all, or a portion of, the nozzle stem 202. The opening may be oriented to receive air directly from the diffusor 120. For example, the opening 205 may be angled to face, or partially face, the diffusor 120 such that air exiting the diffusor 120 is directed into the duct 108. Alternatively or in addition, the opening 205 may be tapered such that the opening 205 of the scoop 106 on a first side 216 of the nozzle assembly 102 is radially offset from the opening 205 of the scoop 106 on a second side 218 of the nozzle assembly 102. The first side 216 of the nozzle assembly 102 may be closer to the diffusor 120 and/or compressor than the second side 218 of the nozzle assembly 102.

Air flowing from the diffusor 120 may flow into the opening 205. The opening 205 may open into the CDP cavity 122. The opening 205 may be positioned to receive air from an outlet of the diffusor 120 that only passes through the CDP cavity 122 from the outlet of the diffusor to the opening 205 of the scoop 106. Alternatively or in addition, the air 224 from the diffusor 120 may flow substantially in the radial direction R that is substantially parallel to the nozzle stem 202 of the fuel spray nozzle 104. The scoop 106 may redirect the air to the inlet of the nozzle head 204. For example, the scoop 106 may redirect the air to flow along an axial direction A substantially perpendicular to the radial direction R. Alternatively or in addition, air received by the duct 108 may travel along the duct 108 in a radial or semi-radial direction, such as the inward radial direction R, relative to the gas turbine engine. The scoop 106 may redirect an airflow from the radial direction to the axial direction A. The nozzle head 204 may receive the redirected airflow.

In other examples, the scoop may have a first end 220 and a second end 222. The first end 220 may be radially offset from the second end 222. The second end 222 may be closer to the nozzle head 204 then the first end 220. In some examples (not illustrated in FIG. 1), the scoop 106 may flare to capture air from the diffusor 120. For example, cross-sectional area of the opening 205 may be larger at the first end 220 of the scoop compared with the second end 222 of the scoop. In other examples, the opening 205 of the duct may be oriented in any way to increase air capture from the diffusor 120.

Figure 3:
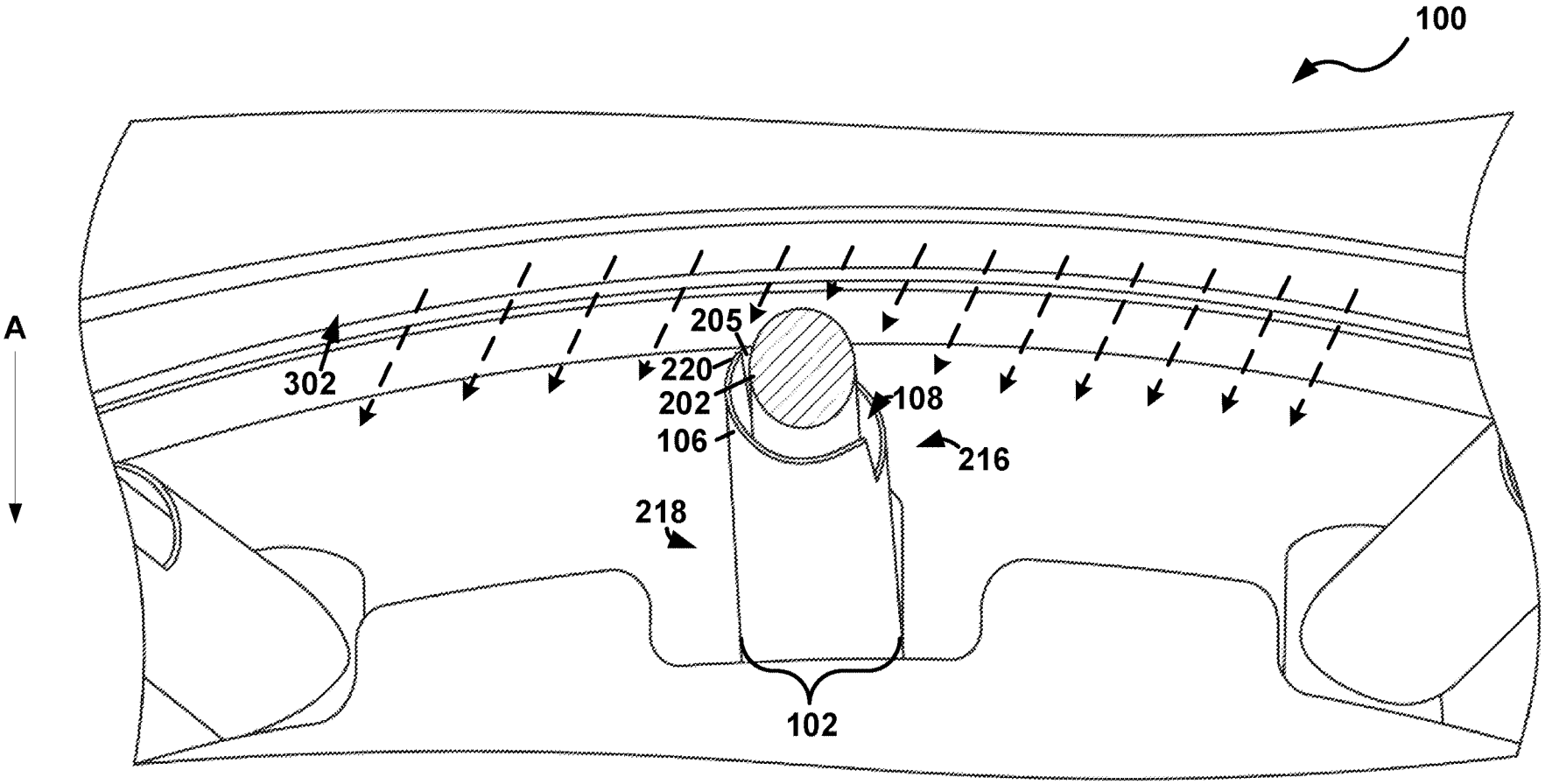
FIG. 3 illustrates a perspective view of a nozzle assembly for a fuel injection system.

FIG. 3 illustrates a perspective view of the nozzle assembly 102 for the fuel injection system 100. As illustrated in FIG. 3, the opening 205 of the scoop 106 may be shaped and/or oriented to capture air flowing from a diffusor exit 302. The opening 205 may extend partially or completely around the nozzle stem 202 and/or the nozzle head 204. For example air flowing from the diffusor exit 302 may flow around the nozzle stem 202 and into the opening 205. Alternatively or in addition, air flowing from the diffusor exit 302 may flow around the nozzle stem 202 and enter the duct 108 after being redirected by the scoop 106. In some examples, the first end 220 of the scoop 106 on the first side 216 of the nozzle assembly 102 may be closer to the nozzle head 204 than the first end 220 of the scoop 106 on the second side 218 of the nozzle assembly 102. Alternatively or in addition, the first end 220 of the scoop 106 may define an outer perimeter of the opening 205 of the duct 108.

Alternatively or in addition, the first end 220 of the scoop 106 and the nozzle stem 202 may define the opening 205 of the duct 108. The duct 108 may extend from the first end 220 of the scoop 106 to a second end 222 of the scoop 106. The second end 222 of the scoop 106 may direct air to the nozzle head 204. The opening 205 may end from the first side 216 to the second side 218 of the nozzle stem 202 and/or nozzle assembly 102. The first side 216 may be closer to the diffusor exit 302 than the second side 218. The opening 205 along the first side 216 may be closer to the nozzle head 204 than along the second side 218.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible. Accordingly, the embodiments described herein are examples, not the only possible embodiments and implementations.

The subject-matter of the disclosure may also relate, among others, to the following aspects:

1. A fuel injection system comprising:

a fuel spray nozzle including a nozzle stem and a nozzle head, the nozzle stem configured to extend into a compressor discharge pressure cavity, the nozzle head comprising an air channel, the air channel configured to receive fuel from the nozzle stem; and a scoop configured to receive air that flows into the compressor discharge pressure cavity from a diffusor, wherein an inner surface of the scoop and an outer surface of the fuel spray nozzle define a duct that extends along the outer surface of the fuel spray nozzle to the nozzle head, wherein the duct is in fluid communication with the air channel, and wherein the air channel receives the air flowing from the diffusor via the duct.

2. The fuel injection system of aspect 1, wherein the scoop is coupled to the fuel spray nozzle.

3. The fuel injection system of any of aspects 1 to 2, wherein the nozzle head further comprises a swirler configured to receive air from the duct, wherein the air channel receives air from the swirler.

4. The fuel injection system of any of aspects 1 to 3, wherein the nozzle head further comprises a swirler outside of the air channel, the swirler configured to receive air from the duct, wherein the air received by the swirler bypasses the air channel.

5. The fuel injection system of any of aspects 1 to 4, wherein the compressor discharge pressure cavity is configured to receive air from a centrifugal compressor.

6. The fuel injection system of any of aspects 1 to 5, wherein the outer surface of the fuel spray nozzle comprises an outer surface of the nozzle stem, wherein the outer surface of the nozzle stem and the inner surface of the scoop define an opening of the duct, wherein the opening is oriented to receive air form the diffusor.

7. The fuel injection system of any of aspects 1 to 6, wherein at least a portion of the nozzle head and at least a portion of the nozzle stem are disposed in the scoop.

8. A nozzle assembly comprising:

an fuel spray nozzle configured to extend into a compressor discharge pressure cavity and convey fuel to a head of the fuel spray nozzle, the head of the fuel spray nozzle comprising an air inlet configured to receive air for a combustor; and a scoop coupled to the fuel spray nozzle, the scoop configured to receive air from the compressor discharge pressure cavity, wherein an outer surface of the fuel spray nozzle and inner surface of the scoop define a duct in fluid communication with the air inlet, wherein the duct extends along the outer surface of the fuel spray nozzle from a stem of the fuel spray nozzle to the head of the fuel spray nozzle, and wherein the air inlet receives the air from the compressor discharge pressure cavity via the duct.

9. The nozzle assembly of aspect 8, wherein the head of the fuel spray nozzle further comprises an air channel, the air channel configured to receive fuel from a stem of the fuel spray nozzle and air from the duct, wherein the air channel is further configured to convey a mixture of fuel and air into the combustor.

10. The nozzle assembly of any of aspects 8 to 9, wherein the air channel receives air from the air inlet.

11. The nozzle assembly of any of aspects 8 to 10, wherein the fuel spray nozzle comprises a first output and a second output, wherein the first output is configured to release a mixture of fuel and air received from the air channel and the second output is configured to release air from the air inlet.

12. The nozzle assembly of any of aspects 8 to 11, wherein the head of the fuel spray nozzle further comprises a swirler configured to receive air conveyed by the duct.

13. The nozzle assembly of any of aspects 8 to 12, wherein the head of the fuel spray nozzle further comprises a second air inlet, wherein the second air inlet receives air from the duct.

14. The nozzle assembly of any of aspects 8 to 13, wherein the scoop receives air that flows substantially in a radial direction that is substantially parallel to a nozzle stem of the fuel spray nozzle and redirects the air to flow along an axial direction substantially perpendicular to the radial direction.

15. A fuel injection system comprising:

a fuel spray nozzle including a nozzle head and a nozzle stem, the nozzle head comprising an air channel and a swirler in fluid communication with the air channel, the nozzle stem configured to extend into a compressor discharge pressure cavity and convey fuel to the air channel, the air channel configured to combine air from the swirler with the fuel from the nozzle stem and convey a mixture of fuel and air to a combustor; and a scoop configured to receive air flowing in the compressor discharge pressure cavity from a diffusor, wherein an outer surface of the fuel spray nozzle and an inner surface of the scoop define a duct in fluid communication with the swirler, wherein the swirler receives air from the duct.

16. The fuel injection system of aspect 15, wherein the scoop is coupled to the nozzle head.

17. The fuel injection system of any of aspects 15 to 16, the scoop defines an opening that extends around the nozzle stem, wherein the opening is angled to receive air flowing from the diffusor.

18. The fuel injection system of any of aspects 15 to 17, wherein the nozzle head is positioned in the compressor discharge pressure cavity radially inward from the diffusor.

19. The fuel injection system of any of aspects 15 to 18, wherein the swirler comprises an inner swirler, the fuel injection system further comprising an outer swirler in fluid communication with the duct, where the inner swirler is disposed inside of the air channel and the outer swirler positioned outside of the air channel, wherein air received by the outer swirler bypasses the air channel.

20. The fuel injection system of any of aspects 15 to 19, wherein an end of the scoop wraps around the stem, wherein the end of the scoop and the stem define an opening of the duct, wherein the opening extends from a first side of the stem to a second side of the stem, wherein the first side is closer to the diffusor than the second side, wherein the end of the scoop along the first side is closer to the nozzle head than the end of the scoop on the second side.

What is claimed is:

1. A fuel injection system comprising:

a fuel spray nozzle including a nozzle stem and a nozzle head, the nozzle stem configured to extend into a compressor discharge pressure cavity, the nozzle stem and at least a portion of the nozzle head positioned external to a combustor, the nozzle head comprising an air channel and an outlet, the air channel configured to receive fuel from the nozzle stem and provide the fuel into the combustor via the outlet; and a scoop comprising a cylindrical portion configured to completely wrap around the nozzle stem and receive air that flows into the compressor discharge pressure cavity from a diffusor, wherein an inner surface of the scoop and an outer surface of the fuel spray nozzle define a duct that extends along the outer surface of the fuel spray nozzle to the nozzle head, wherein the duct is in fluid communication with the air channel, wherein the air channel receives the air flowing from the diffusor via the duct, wherein the cylindrical portion of the scoop and the outer surface of the fuel spray nozzle along the nozzle stem define an opening of the duct, wherein the opening on a first side of the fuel spray nozzle extends further away from the nozzle head than the opening of the scoop on a second side of the fuel spray nozzle, wherein the outlet of the nozzle head is on the first side of the fuel spray nozzle, wherein the second side of the fuel spray nozzle faces the diffusor and the first side is opposite the second side, and wherein the cylindrical portion of the scoop extends along the nozzle stem from the opening to the nozzle head.

2. The fuel injection system of claim 1, wherein the scoop is coupled to the fuel spray nozzle.

3. The fuel injection system of claim 1, wherein the nozzle head further comprises a swirler configured to receive air from the duct, wherein the air channel receives air from the swirler.

4. The fuel injection system of claim 1, wherein the nozzle head further comprises a swirler outside of the air channel, the swirler configured to receive air from the duct, wherein the air received by the swirler bypasses the air channel.

5. The fuel injection system of claim 1, wherein the compressor discharge pressure cavity is configured to receive air from a centrifugal compressor.

6. The fuel injection system of claim 1 wherein the opening is oriented to receive air from the diffusor.

7. The fuel injection system of claim 1, wherein at least a portion of the nozzle head is disposed in the scoop.

8. A nozzle assembly comprising:

a fuel spray nozzle configured to extend into a compressor discharge pressure cavity and convey fuel to a head of the fuel spray nozzle, the head of the fuel spray nozzle comprising an outlet configured to provide the fuel to a combustor, the head of the fuel spray nozzle comprising an air inlet configured to receive air for the combustor, at least a portion of the head of the fuel spray nozzle positioned external to the combustor; and a scoop comprising a cylindrical portion configured to completely wrap around a stem of the fuel spray nozzle, the scoop configured to receive air from the compressor discharge pressure cavity from a diffusor, wherein an outer surface of the fuel spray nozzle and inner surface of the scoop define a duct in fluid communication with the air inlet, wherein the duct extends along the outer surface of the fuel spray nozzle from the stem of the fuel spray nozzle to the head of the fuel spray nozzle, wherein the air inlet receives the air from the compressor discharge pressure cavity via the duct, wherein the cylindrical portion of the scoop and the outer surface of the fuel spray nozzle along the nozzle stem define an opening of the duct, wherein the opening on a first side of the fuel spray nozzle extends further away from the head of the fuel spray nozzle than the opening of the scoop on a second side of the fuel spray nozzle, wherein the outlet of the head of the fuel spray nozzle is on the first side of the fuel spray nozzle, wherein the second side of the fuel spray nozzle faces a diffusor and the first side is opposite the second side, and wherein the cylindrical portion of the scoop extends along the stem of the fuel spray nozzle from the opening to the head of the fuel spray nozzle.

9. The nozzle assembly of claim 8, wherein the head of the fuel spray nozzle further comprises an air channel, the air channel configured to receive fuel from the stem of the fuel spray nozzle and air from the duct, wherein the air channel is further configured to convey a mixture of fuel and air into the combustor.

10. The nozzle assembly of claim 9, wherein the air channel receives air from the air inlet.

11. The nozzle assembly of claim 9, wherein the outlet is a first outlet, wherein the fuel spray nozzle further comprises a second outlet, wherein the first outlet is configured to release a mixture of fuel and air received from the air channel and the second outlet is configured to release air from the duct.

12. The nozzle assembly of claim 8, wherein the head of the fuel spray nozzle further comprises a swirler configured to receive air conveyed by the duct.

13. The nozzle assembly of claim 8, wherein the head of the fuel spray nozzle further comprises a second air inlet, wherein the second air inlet receives air from the duct.

14. The nozzle assembly of claim 8, wherein the scoop receives air that flows substantially in a radial direction that is substantially parallel to the stem of the fuel spray nozzle and redirects the air to flow along an axial direction substantially perpendicular to the radial direction.

15. A fuel injection system comprising:

a fuel spray nozzle including a nozzle head and a nozzle stem, at least a portion of the nozzle head positioned external to a combustor, the nozzle head comprising an air channel, an outlet, and a swirler in fluid communication with the air channel, the nozzle stem configured to extend into a compressor discharge pressure cavity and convey fuel to the air channel, the air channel configured to combine air from the swirler with the fuel from the nozzle stem and convey a mixture of fuel and air to the combustor via the outlet; and a scoop comprising a cylindrical portion configured to completely wrap around the nozzle stem and receive air flowing in the compressor discharge pressure cavity from a diffusor, wherein an outer surface of the fuel spray nozzle and an inner surface of the scoop define a duct in fluid communication with the swirler, wherein the swirler receives air from the duct, wherein the cylindrical portion of the scoop and the outer surface of the fuel spray nozzle along the nozzle stem define an opening of the duct, wherein the opening on a first side of the fuel spray nozzle extends further away from the nozzle head than the opening of the scoop on a second side of the fuel spray nozzle, wherein the outlet of the nozzle head is on the first side of the fuel spray nozzle, wherein the second side of the fuel spray nozzle faces the diffusor and the first side is opposite the second side, and wherein the cylindrical portion of the scoop extends along the nozzle stem from the opening to the nozzle head.

16. The fuel injection system of claim 15, wherein the scoop is coupled to the nozzle head.

17. The fuel injection system of claim 15, wherein the opening is angled to receive air flowing from the diffusor.

18. The fuel injection system of claim 15, wherein the nozzle head is positioned in the compressor discharge pressure cavity radially inward from the diffusor.

19. The fuel injection system of claim 15, wherein the swirler comprises an inner swirler, the fuel injection system further comprising an outer swirler in fluid communication with the duct, where the inner swirler is disposed inside of the air channel and the outer swirler positioned outside of the air channel, wherein air received by the outer swirler bypasses the air channel.

* * * * *